United States Patent [19]

Scholler

[11] 4,219,975

[45] Sep. 2, 1980

[54] SKATE SHARPENER

[76] Inventor: Martin Scholler, 400 Marie-Victorin, Boucherville, Quebec, Canada, J4B 1W2

[21] Appl. No.: 964,368

[22] Filed: Nov. 28, 1978

[51] Int. Cl.[3] ..... B24B 9/04

[52] U.S. Cl. ..... 51/205 WG; 51/214; 76/83

[58] Field of Search ..... 51/205 WG, 208, 214, 51/228, 173, 170 PT, 241 G, 241 S, 391; 76/83, 82.2, 88

[56] References Cited

U.S. PATENT DOCUMENTS

| | | | |
|---|---|---|---|
| 555,974 | 3/1896 | Roberts et al. . | |
| 750,696 | 1/1904 | Price | 76/83 |
| 927,131 | 7/1909 | Dow | 76/83 |
| 1,335,813 | 4/1920 | Berghman . | |
| 1,622,476 | 3/1927 | Turi . | |
| 1,672,547 | 6/1928 | Swartz . | |
| 2,092,831 | 9/1937 | Cannon | 51/205 WG |
| 2,251,849 | 8/1941 | Mawle | 51/208 |
| 2,978,930 | 4/1961 | Bratton . | |
| 2,999,402 | 9/1961 | Bratton . | |
| 3,575,068 | 4/1971 | Stafford . | |
| 3,812,626 | 5/1974 | Thompson . | |

FOREIGN PATENT DOCUMENTS

| | | | |
|---|---|---|---|
| 683014 | 6/1930 | France | 51/205 WG |

*Primary Examiner*—Nicholas P. Godici
*Attorney, Agent, or Firm*—Bacon & Thomas

[57] ABSTRACT

A skate sharpener having a cylindrical sharpening member held between two symmetrical members forming a holder. A radical slot is provided in the holder for receiving a skate blade to be sharpened by the sharpening member. The width of the slot can be varied to snugly receive skate blades of different width. The sharpening member is centrally retained in the holder, relative to the slot, regardless of the width of the slot.

7 Claims, 4 Drawing Figures

SKATE SHARPENER

This invention relates to an improved skate sharpener.

The invention particularly relates to a manually operated skate sharpener which can be easily adjusted to sharpen skate blades of different thicknesses.

Manual skate sharpeners are well known. One common type, shown in U.S. Pat. No. 555,974 by way of example, employs a cylindrical sharpening stone (along with other shapes of stones) and comprises a holder for the stone. A slot in the holder, parallel to the stone, snugly receives a skate blade. The skate blade is sharpened by drawing the cylindrical stone through the holder along the length of the blade edge. The slot positions the blade radially to the cylindrical stone so as to produce a desirable concave ground edge on the blade.

Sharpeners of the above type can properly sharpen only skate blades having a width substantially corresponding to the width of the slot. If a blade with a width narrower than the width of the slot to be sharpened, the blade cannot be positioned radially to the stone and thus its edge cannot have a desirable concave shape.

To sharpen skate blades having more than one width, another type of sharpener has been proposed, such as for example that shown in U.S. Pat. No. 2,999,402. This other type of sharpener comprises a cylindrical holder having a plurality of slots of different width positioned about a cylindrical stone. This other type of sharpener too has proved to be still good only for sharpening blades of different widths, equal in number to the number of slots of different width.

To overcome the above drawbacks a further type of sharpener has been proposed, in which the width of the slot can be infinitely adjusted. Such a sharpener is shown in U.S. Pat. No. 1,335,813, which discloses a sharpener comprising an adjustable slot the walls of which are not maintained in parallel relation when the width of the slot is adjusted. Thus, it is apparent that the skate blade inserted in the slot is not snugly held at all times. Since the skate blade can wobble in the slot, depending on its width, the result may be an uneven ground edge.

An object of the present invention is to provide a skate blade sharpener which can handle any width of skate blade while sharpening the edge of the blade to a proper concave shape.

Another object of the present invention is to provide a sharpener in which the width of the slot can be varied while maintaining the walls of the slot parallel.

A further object of the present invention is to provide a sharpener in which the cylindrical sharpening stone is maintained in a central position with respect to the slot, regardless of its width, in order to provide a proper concave edge to the blade.

Another object of the present invention is to provide a sharpener which is compact, easy to manufacture and to use, and easy to adjust.

These objects are achieved with a skate sharpener comprising a cylindrical sharpening member and a holder having two symmetrical members for holding the sharpening member between them. Each holding member has means on one side which, when the sides are positioned adjacent each other, defines a skate-blade receiving slot along the length of the holder, the slot extending radially of the sharpening member. The sharpener also comprises means for mounting the holding members about the sharpening member, so that the holding members can be moved to or away from each other to vary the width of the slot. The sharpener further comprises means for retaining the sharpening member centered with respect to the slot when the width of the slot is varied.

A non-restrictive embodiment of skate sharpener according to the present invention will now be described with reference to the accompanying drawings in which.

Figure 1:
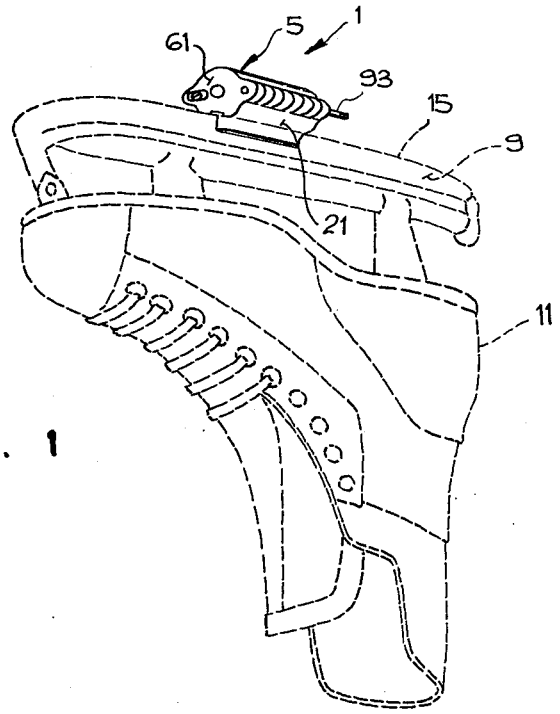
FIG. 1 illustrates how the skate sharpener is used.
Figure 3:
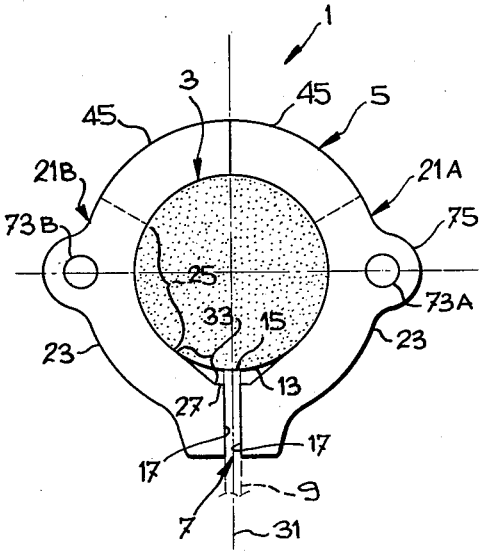
Figure 4:
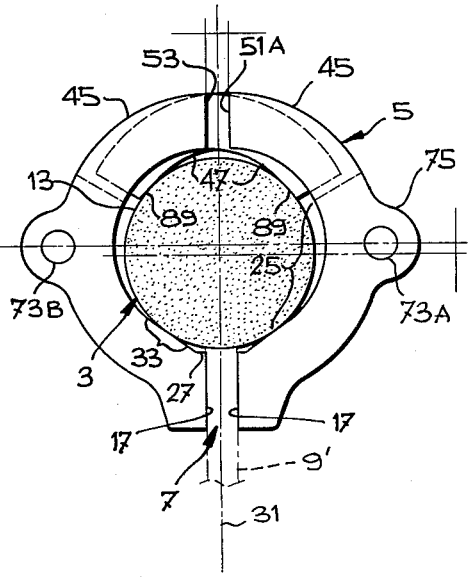

FIG. 3 appearing on the same sheet as FIG. 1, is a cross-section view of the skate sharpener with the skate blade slot set at its narrowest; and FIG. 4 appearing on the same sheet as FIG. 1, is a cross-section view, similar to FIG. 3, with the skate blade slot set at a wider opening.

The skate blade sharpener 1 shown in FIGS. 1 and 3, comprises a cylindrical sharpening member 3 mounted within a holder 5. The sharpening member 3 can comprise a cylindrical member having an abrasive sheet such as a sheet of sand paper fastened about it. Preferably it comprises a cylindrical grind stone but any equivalent grinding media can be used, such as a carboloy disc or a file. The holder 5 has a slot 7 along one side, which slot extends the length of the holder. The slot 7 is parallel to the longitudinal axis of the stone 3 and extends radially to the stone. The sharpener 1 is used to sharpen the blade 9 of a skate 11 by inserting the blade 9 snugly into the slot 7 of the holder 5 to make contact with the cylindrical sharpening surface 13 of the stone. The sharpener is then manually drawn back and forth along the blade, pressing tightly against the edge 15 of the blade with the stone surface 13, to sharpen the blade edge. The sides 17 in the holder 5, defining the slot 7, are parallel and wide enough to snugly retain the skate blade 9 in a radial position with respect to the stone 3, so that the blade edge 15 is ground with a desirable, slightly concave surface.

In accordance with the present invention the holder 5 is constructed so that the width of the slot 7 can be varied, while keeping the sides 17 parallel, so as to snugly accommodate skate blades of different width. In addition the holder 7 is constructed so that the stone 3 is always centered with the holder 5 with respect to the slot 7, regardless of its width. Thus, every blade is radially located with respect to the stone and has its edge 15 properly ground.

In more detail, the holder 5 comprises two identical members 21A and 21B for holding the stone 3 between them. Each holding member 21 has a main, generally curved body 23. The body 23 is sized to encompass approximately one third of the stone 3 and the major portion 25 of its inner surface has a curvature corresponding to the curvature of the outer surface 13 of the stone. One side 17 of the body 23 is a flat guide surface, which surface extends parallel to a radial plane 31 extending from the axis of curvature of the curved major portion 25 of the inner surface of the body. The guide surface 17 is located closely adjacent to the radial plane 31.

A cam surface 33 is located on the inner surface of each body 23. This cam surface 33 is located between the curved surface portion 25 and a flat surface 27 edging the flat guide surface 17. The edging surface 27 is used for extending the surface area of the guide surface 17. The cam surface 33 is straight and extends up and way from the edging surface 27.

Each holder member 21 includes cam elements extending from the other side 43 of the body 25 up and over the top of the stone. The cam elements comprise curved fingers 45 with an inner surface 47 having the same curvature as the outer surface of the stone. The fingers 45 extend oer approximately one third of the circumference of the stone and are located along the sides 43 of the bodies 25 so that the fingers 45 on the one member 21 mesh with the fingers 45 on the other member 21 to cover the top of the stone. If desired, one end finger 45A on each holder member 21 may be made half as long as the other fingers. The opposite end fingers 45B on each holder member then have a cutout 49 to receive the short end finger 45A of the other member. The end 51A of each short finger abuts on the shoulder 53 of cutout 49. The ends 51 of the other fingers 45 abut on the opposite side 43 of the other holding member 21.

The holder members 21 and the enclosed stone 3 are mounted between a pair of identical end plates 61. Each end plate 61 sits on a shoulder 63, formed by a projection 65 extending laterally from the bottom of each end 67 of each holder member 21. Each end plate 61 sits flush against the end surfaces 67 of the holder members and has a wide slot 101 to allow the blade 9 to contact the stone 3 is use. Each end plate 61 has a threaded hole 69 on one side and a slot 71 on the other side opposite hole 69.

Each holder member 21 has a raised rib 75 on its outer surface located at an angle of about 90° from the guide surface 17 and parallel to the stone 3, and a through hole 73 passing through the member 21 where the rib 75 is located.

Figure 2:
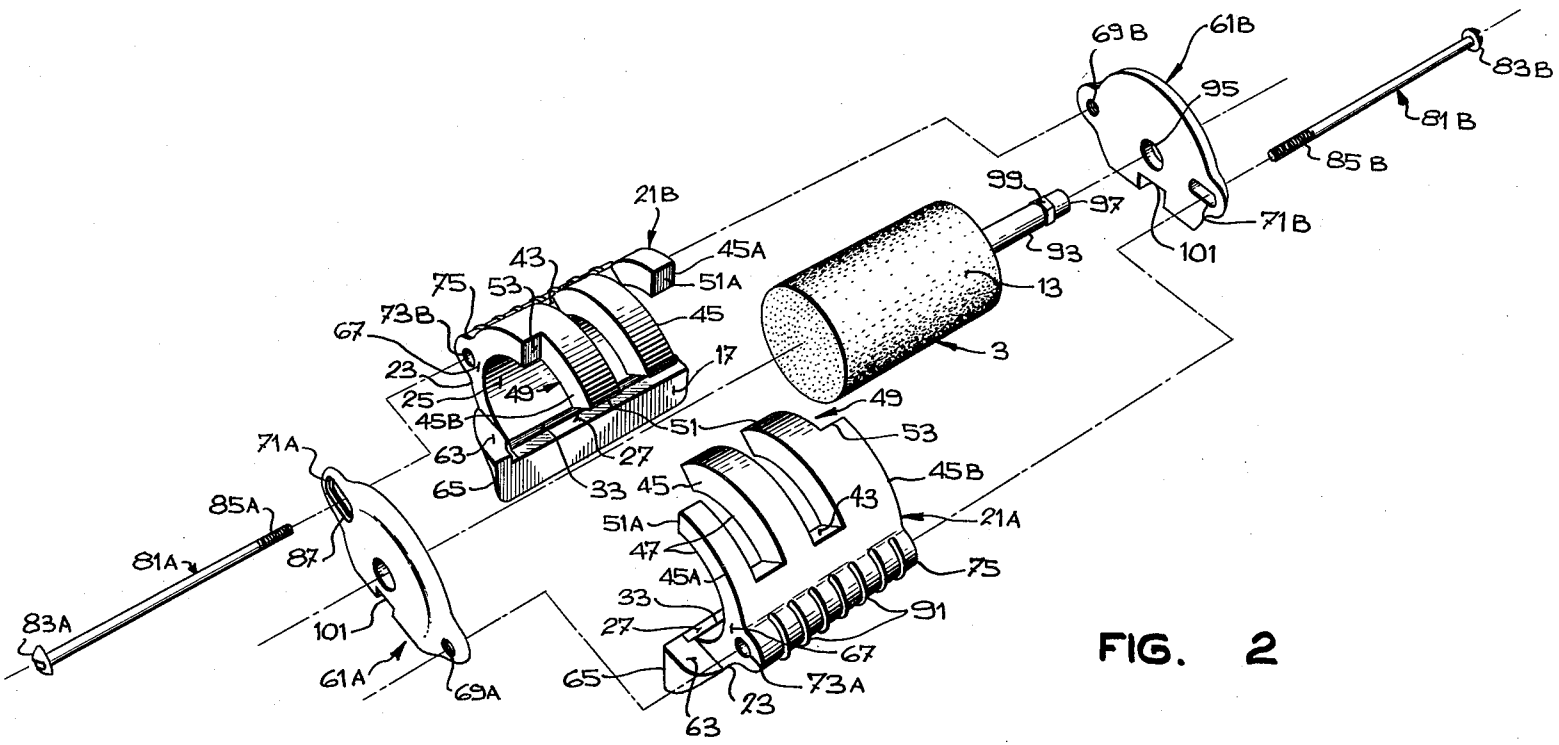
FIG. 2 is an exploded, schematic view showing the parts of the skate sharpener.

When the two holder members 21 are mounted about the stone 3 and the end plates 61 are abutted against the ends 67 of the holder members 21, the hole 69 and slot 71 in each end plate are aligned with the through holes 73 in the two members. The hole 69A in one plate 61A and the slot 71B in the other plate 61B are aligned with the hole 73A in one member 21A; and the slot 71A in the plate 61A, and the hole 69B in the other plate 61B are aligned with the hole 73B in the other member 21B as shown in FIG. 2. A pair of screws 81 hold the plates 61 together with the holder members 21 and the stone 3 sandwiched between. One screw 81A is passed in one direction with its head 83A adjacent to the slot 71A in one plate 61A, and its end 85A threaded into the aligned hole 69B in the other plate 61B. The other screw 81B is passed in the opposite direction with its head 83B adjacent to the slot 71B in the other plate 61B, and its end 85B threaded into the hole 69A in the one plate 61A. If desired a countersunk slot 87 can be provided about each slot 71 in each plate 61, so that the screw heads 83 can be recessed in the plates.

When the holder 5 is assembled with the screws 81, the holder members 21 normally snugly encompass the stone 3. The fingers 45 are meshed together over the top of the stone 3 and the guide surfaces 17 at the bottom of the stone are slightly spaced apart, and parallel, to form the slot 7 receiving the narrowest skate blade 9. If a wider blade 9' is to be sharpened, as shown in dotted line in FIG. 4, the slot 7 can be widened by inserting a coin or other lever-type member in the slot and twisting it to move the surfaces 17 apart while they remain parallel.

As the guide surfaces 17 are moved apart, the holding members 21 are laterally forced apart and the curved fingers 45 move apart. The outer portion 89 of the inner surfaces 47 of the fingers cam the top sides of the stone 3 which holding it centered relative to the wider slot. The stone is cammed down slightly toward the slot 7 along the straight, cam surfaces 33 of the members, which surfaces have also moved apart. After the slot 7 has received the wider blade 9, the members 21 are maually squeezed together pressing the sides 17 snug against the blade to properly position its edge relative to the stone.

When the slot 7 is to be narrowed, the holder members 21 are manually moved together. The cam surfaces 33 on members 21 then raise the stone 3 and keep it centered, relative to the slot, along with the ends 89 of the curved fingers 45.

It is noted that the members 21 are able to move apart due to the slots 71 in the end plates 61. The tightness of the screws 81 determines how easily the width of the slot 7 can be adjusted.

This arrangement provides infinite slot width adjustment while positively retaining the stone 3 centered with respect to the slot regardless of its width.

The ribs 75 of the opposite sides of the holder 5 provide a convenient gripping region for handling the sharpener. To minimize slipping, a plurality of spaced-apart transverse raised ribs 91 can be provided on the outer surface on each rib 75.

Preferably a stem 93 extends axially from one end of the stone 3. The stem passes through a central hole 95 in an end plate 61 to project from the holder. Rotation of the stem rotates the stone within the holder to present fresh sharpening surfaces adjacent the slot 7. If desired, the stem adjacent its free end 97 can be provided with a collar 99 of hexagon shape, whereby a drill or a motor can be attached to the stem, via the collar, to rapidly rotate the stone while drawing it along a skate blade. A second stem could also project from the other end of the stone if desired.

Preferably also, the holder parts, and the stem, are molded from suitable thermoplastic material.

As can be seen, the above described skate sharpener is of particular significance since it keeps the grinding stone parfectly in the center, regardless of whether the grinding sides are opened or closed to accomodate different size of skate blades. Moreover it still allows the grinding stone to be turned for new grinding action to avoid excessive une on one spot only.

I claim:

1. A skate sharpener comprising:

a cylindrical sharpening member;

a holder having two symmetrical members for holding the sharpening member between them, each holding member having means on one side which, when the sides are positioned adjacent each other, define a skate-blade receiving slot along the length of the holder said slot extending radially of the sharpening member;

means for mounting the holding members about the sharpening member so that said holding members can be moved toward or away from each other to vary the width of said slot; and means for retaining the sharpening member centered with respect to said slot when the width of the slot is varied;

said retaining means including cam elements on said holding members to cam the sharpening member toward said slot when the holding members are moved apart, said cam elements comprising curved fingers on each holding member, extending from the other side of each holding member, over the surface of the sharpening member opposite said slot, to the other side of the other holding member, the fingers on both holding members meshing with each other to substantially cover the surface of the sharpening member opposite the slot.

2. A skate sharpener as claimed in claim 1 wherein the sides of the holder defining the slot are parallel regardless of the width of the slot.

3. A skate sharpener as claimed in claim 1 wherein the inner surface of the fingers have the same center of curvature as the outer surface of the sharpening member.

4. A skate sharpener as claimed in claim 3 wherein the retaining means further include cam surfaces on the holding members, adjacent the slot, for camming the sharpening member away from the slot as the holding members are moved together.

5. A skate sharpener as claimed in claim 4 wherein the cam surfaces comprise a straight surface portion of the inner surface of each holding member, adjacent to the slot, extending up and away from the slot.

6. A skate sharpener as claimed in claim 1 including a stem extending axially from the sharpening member and out of the holder for rotating the sharpening member in the holder.

7. A skate sharpener comprising:

a cylindrical sharpening member;

a holder having two symmetrical members for holding the sharpening member between them, each holding member having means on one side which, when the sides are positioned adjacent each other, define a skate-blade receiving slot along the length of the holder, said slot extending radially of the sharpening member;

means for mounting the holding members about the sharpening member so that said holding members can be moved toward or away from each other to vary the width of said slot, said mounting means including end plates for mounting the holding members and sharpening member therebetween, and a pair of screws connecting the end plates together, said screws passing through the holding members on opposite sides of the sharpening member and being, at each end plate, movable toward or away from each other to allow the holding members to move toward or away from each other; and means for retaining the sharpening member centered with respect to said slot when the width of the slot is varied.

* * * * *